US011741929B2

(12) United States Patent
Campbell

(10) Patent No.: US 11,741,929 B2
(45) Date of Patent: Aug. 29, 2023

(54) DYNAMIC NETWORK BASED SOUND MASKING

(71) Applicant: Biamp Systems, LLC, Beaverton, OR (US)

(72) Inventor: Jacob Peter Campbell, Beaverton, OR (US)

(73) Assignee: Biamp Systems, LLC, Beaverton, OR (US)

( * ) Notice: Subject to any disclaimer, the term of this patent is extended or adjusted under 35 U.S.C. 154(b) by 0 days.

(21) Appl. No.: 17/580,522

(22) Filed: Jan. 20, 2022

(65) Prior Publication Data

US 2022/0230614 A1 Jul. 21, 2022

Related U.S. Application Data

(60) Provisional application No. 63/139,804, filed on Jan. 21, 2021.

(51) Int. Cl.

| | |
|---|---|
| ***G10K 11/175*** | (2006.01) |
| ***H04R 3/00*** | (2006.01) |
| ***H04R 3/12*** | (2006.01) |

(52) U.S. Cl.

CPC ..... *G10K 11/1752* (2020.05); *H04R 3/005* (2013.01); *H04R 3/12* (2013.01); *H04R 2410/05* (2013.01)

(58) Field of Classification Search

CPC ..... G10K 11/1752; H04R 3/005; H04R 3/12; H04R 2410/05

USPC ..... 381/56, 58, 71.14, 73.1, 94.2, 94.3

See application file for complete search history.

(56) References Cited

U.S. PATENT DOCUMENTS

| | | | | |
|---|---|---|---|---|
| 10,142,762 | B1 * | 11/2018 | Prasad | G10L 19/26 |
| 2003/0107478 | A1 * | 6/2003 | Hendricks | H04K 3/825 340/311.2 |
| 2010/0158263 | A1 * | 6/2010 | Katzer | G10K 11/1752 381/73.1 |
| 2013/0259254 | A1 * | 10/2013 | Xiang | H04K 3/45 381/73.1 |

* cited by examiner

*Primary Examiner* — William A Jerez Lora

(57) ABSTRACT

An example process may include identifying an area of an environment to emit one or more sound masking signals, determining a noise level of one or more surrounding areas adjacent to the area, selecting one or more frequency ranges and respective amplitudes of the one or more sound masking signals to apply to the area based on the noise level, and emitting the masking signals via one or more emitters disposed in the area.

17 Claims, 7 Drawing Sheets

DYNAMIC NETWORK BASED SOUND MASKING

CROSS-REFERENCE TO RELATED APPLICATIONS

This application claims priority to previously filed provisional application No. 63/139,804, entitled 'NETWORKED MEDIA SOUND MASKING', which was filed on Jan. 21, 2021 and is hereby incorporated by reference in its entirety.

BACKGROUND

In a workplace, conference area, public forum or other environment, the audio producing speakers/emitters may be arranged in a networked configuration that covers multiple floors, areas and different sized rooms. Targeting certain areas with audio while desiring to limit the amount of audio in other areas has presented a challenge to the manufacturers and design teams of such large-scale audio systems.

SUMMARY

One example embodiment may provide an apparatus that includes a plurality of emitters disposed throughout an environment, and a controller in communication with the plurality of emitters via a communication medium, and the controller selects a frequency and output level to emit a sound from the plurality of emitters to reduce a level of noise from one or more areas of the environment.

Another example embodiment may include a process including one or more of identifying an area of an environment to emit one or more sound masking signals, determining a noise level of one or more surrounding areas adjacent to the area, selecting one or more frequency ranges and respective amplitudes of the one or more sound masking signals to apply to the area based on the noise level, and emitting the masking signals via one or more emitters disposed in the area.

Still another example embodiment may include a system that includes one or more of a plurality of emitters disposed throughout an environment, and a controller in communication with the plurality of emitters via a communication medium, and wherein the controller is configured to identify an area of the environment to emit one or more sound masking signals, determine a noise level of one or more surrounding areas adjacent to the area, select one or more frequency ranges and respective amplitudes of the one or more sound masking signals to apply to the area based on the noise level, and emit the masking signals via one or more emitters disposed in the area.

Still another example embodiment may include a non-transitory computer readable storage medium configured to store instructions that when executed cause a processor to perform identifying an area of an environment to emit one or more sound masking signals, determining a noise level of one or more surrounding areas adjacent to the area, selecting one or more frequency ranges and respective amplitudes of the one or more sound masking signals to apply to the area based on the noise level, and emitting the masking signals via one or more emitters disposed in the area.

DETAILED DESCRIPTION

Figure 1A:
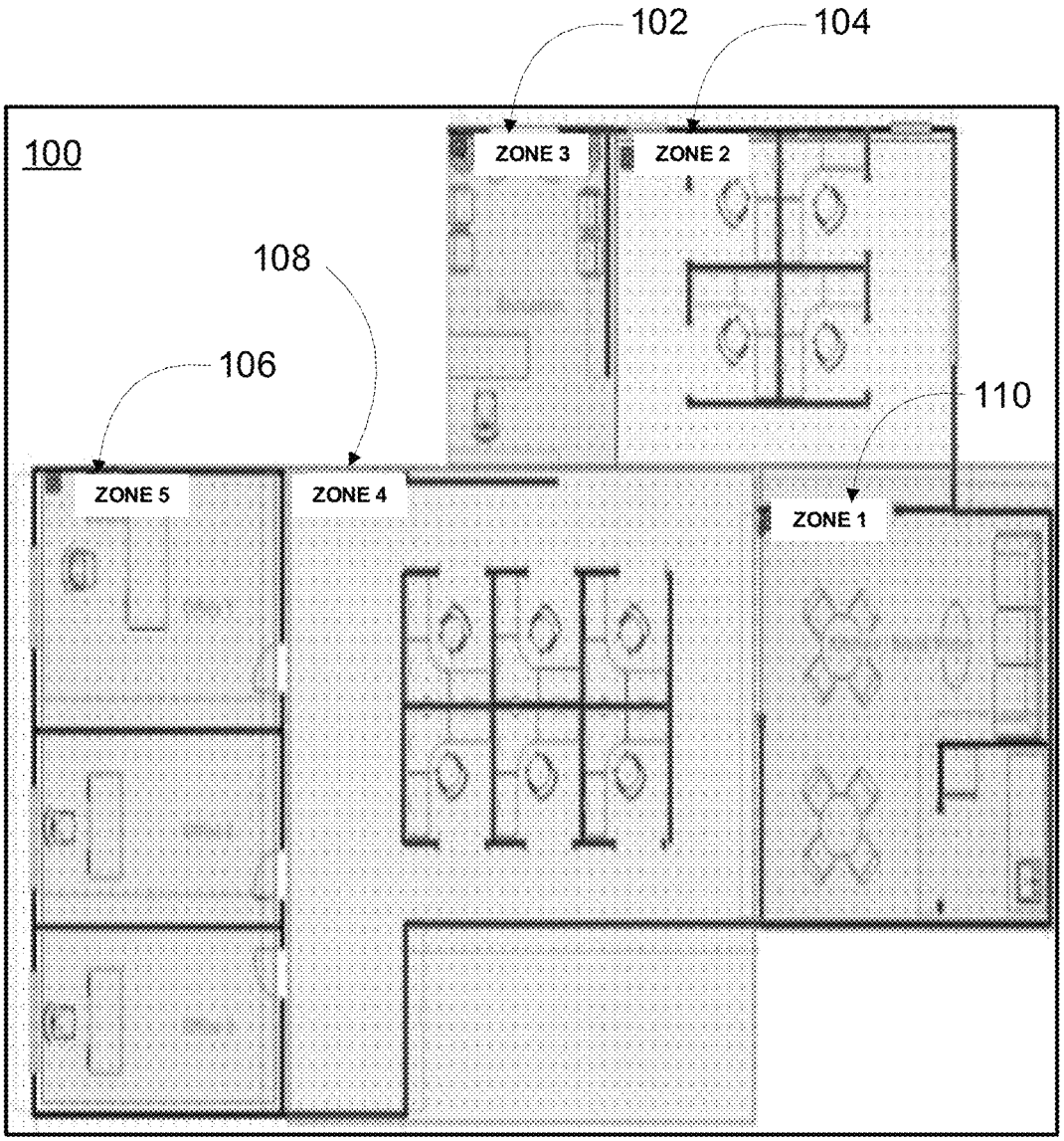
FIG. 1A illustrates a controlled speaker environment according to example embodiments.

It will be readily understood that the instant components, as generally described and illustrated in the figures herein, may be arranged and designed in a wide variety of different configurations. Thus, the following detailed description of the embodiments of at least one of a method, apparatus, non-transitory computer readable medium and system, as represented in the attached figures, is not intended to limit the scope of the application as claimed, but is merely representative of selected embodiments.

The instant features, structures, or characteristics as described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In addition, while the term "message" may have been used in the description of embodiments, the application may be applied to many types of network data, such as, packet, frame, datagram, etc. The term "message" also includes packet, frame, datagram, and any equivalents thereof. Furthermore, while certain types of messages and signaling may be depicted in exemplary embodiments they are not limited to a certain type of message, and the application is not limited to a certain type of signaling.

Example embodiments provide a system that includes a controller or central computer system to manage a plurality of speakers to provide noise management in a particular environment. The system may propagate a special audio signal to emitters/speakers hereinafter 'emitters' with frequency properties such that the output of the emitters makes human voices and other types of sounds difficult to discern (i.e., hear) beyond a certain distance, effectively "masking" the sound of the emitters, and providing for privacy to those in neighboring areas. To ensure that the voices and sounds are masked uniformly, the emitters are distributed throughout an environment in all areas in which sound is to be masked. Control of the corresponding signals is managed via a control signaling network at a central controller.

The sound masking may also propagate music or non-masking signals to control the ambient audio experience for participants in an area to set a particular mood (i.e., relaxing sound, music, noise cancelling sound, etc.) and to provide less noise and reduce distractions from general types of audible noise. Control and propagation of such 'media' is also managed via a media network and control signaling to permit for the delivery of other 'non-masking' signals over large areas. Finally, the audio network created by sound masking and non-sound masking may provide a way for sending directed audio to specific areas of a workplace environment or other environments, and may include transmitting "paging" audio, or emergency signals to certain individuals within a building or space covered by the aforementioned networked audio emitter and related control devices.

The sound masking may be a specifically-tailored audio source (frequency/signal) that is injected into an occupied office/building environment that creates and/or increases speech privacy via output from emitters. In open offices, incorporation of sound masking decreases the distance where conversations may be clearly understood, thereby reducing distractions and increasing privacy for building occupants. This is accomplished by reducing the talker's 'signal-to-noise ratio' as experienced by the listener, (i.e., 'covering' speech of another occupant with a masking signal at the listener's location).

The combination of sound masking and non-masking signals in a single system, using networking protocols permits a single system to provide privacy and ambient experience management, as well as paging, to reduce overall management costs and complexity to end users managing the audio characteristics of a large space.

FIG. 1A illustrates a controlled speaker environment according to example embodiments. Referring to FIG. 1A, the configuration 100 includes a variety of rooms or areas which may be or may be not separated by walls, or, more specifically walls that provide some degree of sound blocking characteristics. In general, noise travels across workplace environments since the walls are seldom built to prevent noise blocking. In this example, a first zone 110 may be a cafeteria or lounge area 110, a second zone 104 may be a set of cubicles with no permanent structures limiting sound, a third zone 102 may be an entrance area, a fourth zone 108 may be additional cubicles, and a fifth zone 106 may include certain closed-door offices for executives and for small conference purposes. In general, the areas which are not closed-door environments offer very limited sound protection which could limit the workplace productivity of others.

Figure 1B:
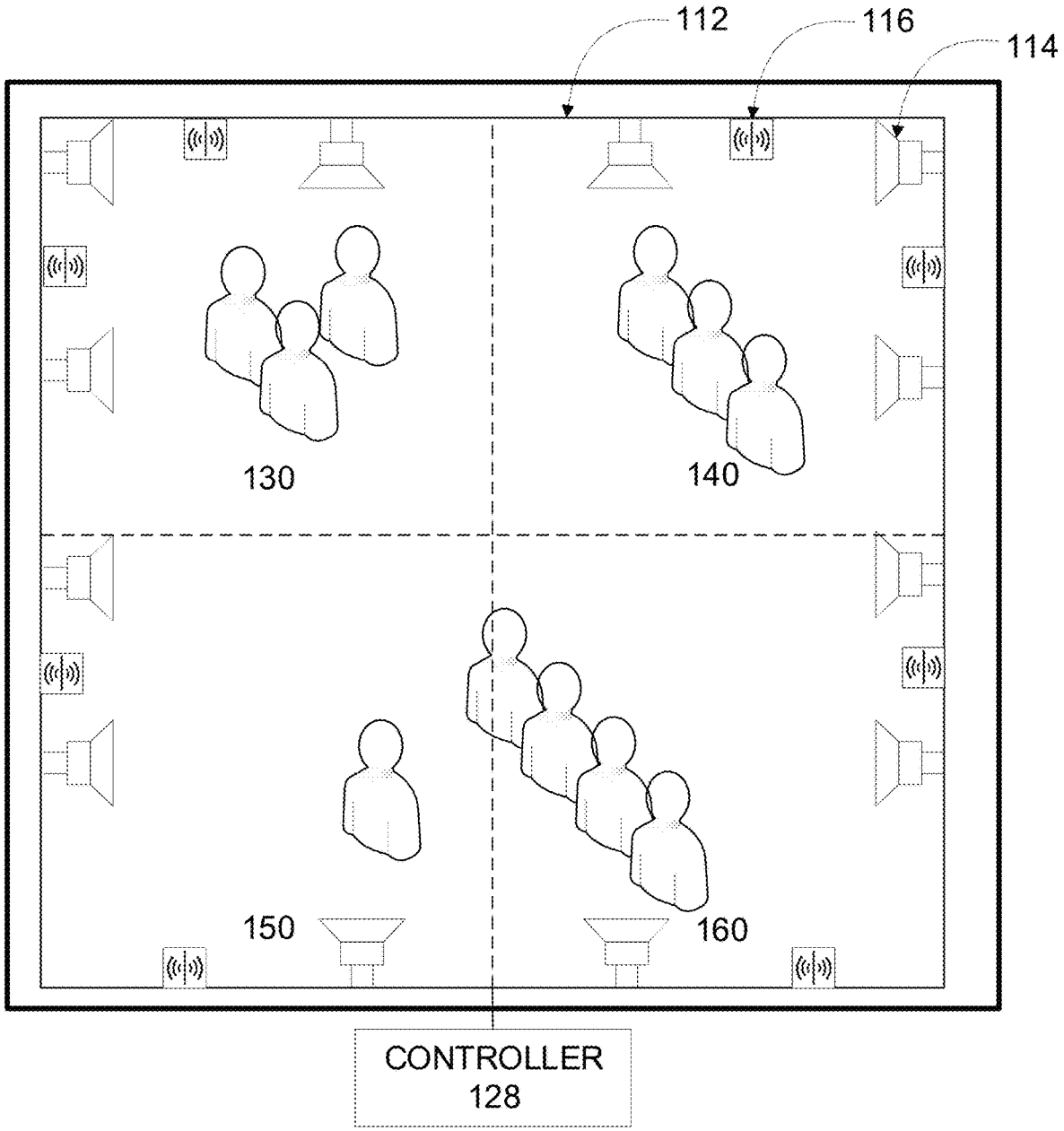
FIG. 1B illustrates a specific example of a controlled speaker environment with emitters/loudspeakers and microphones/sensors according to example embodiments.

FIG. 1B illustrates a specific example of a controlled speaker environment with emitters/loudspeakers and microphones/sensors according to example embodiments. Referring to FIG. 1B, the configuration 100 includes a room or larger environment, such as a multi-room workplace or multi-level open space. The speakers/emitters 114 may be hardwired 112 or wirelessly communicating to one another and/or to a centrally controlled controller 128, which may include a computer, server or similar hardware device configured to manage multiple emitter connections, sensor connections and related hardware necessary to receive feedback from the sensors 116 (i.e., microphones), and to provide a signal to emit sound from the various emitters. Each area 130, 140, 150 and 160 may be statically configured to be a particular size with a fixed square footage and/or fixed dimensions.

Figure 1C:
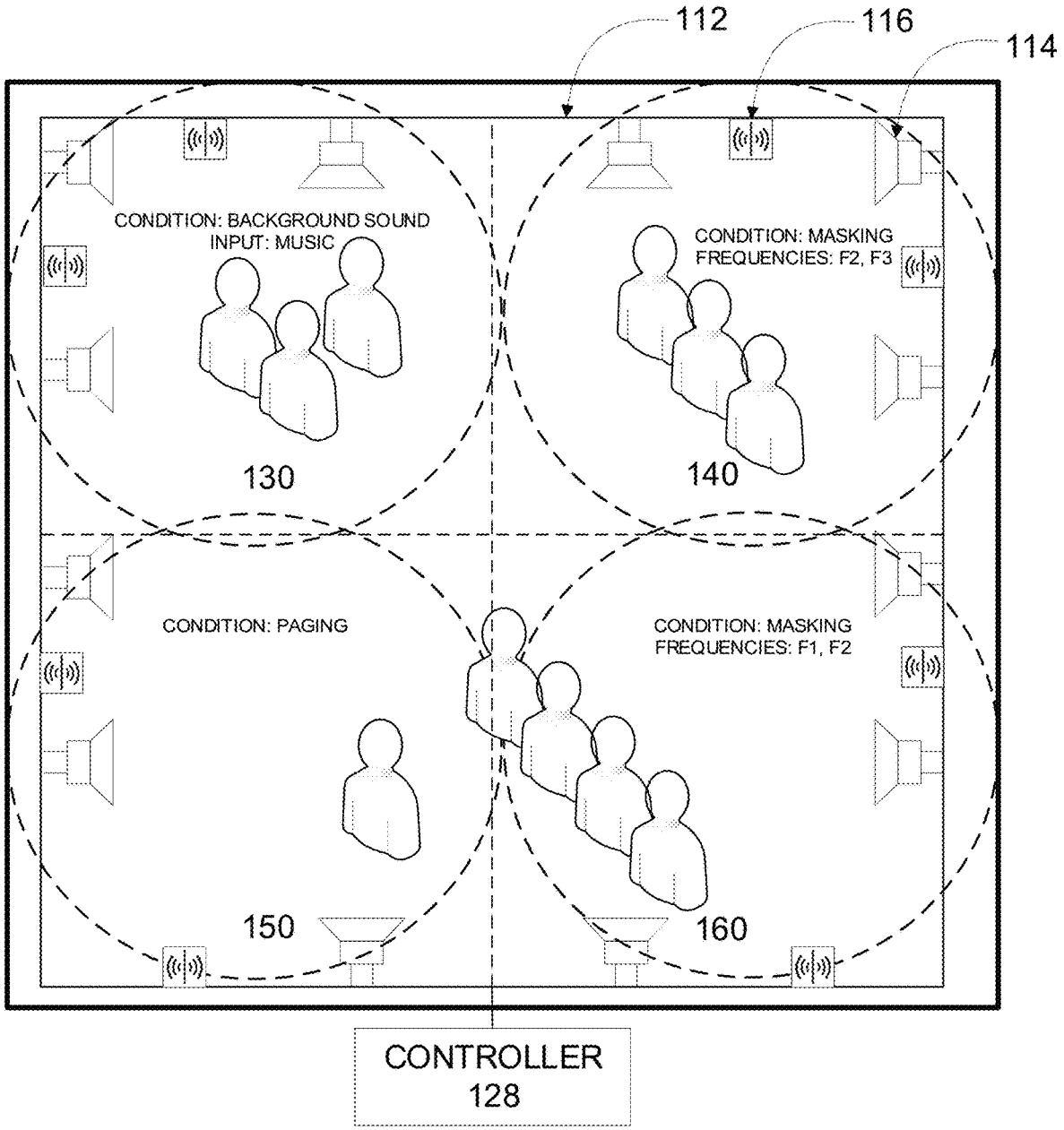
FIG. 1C illustrates a specific example of a controlled speaker environment with emitters/loudspeakers and microphones/sensors providing a variety of different masking functions according to example embodiments.

FIG. 1C illustrates a specific example of a controlled speaker environment with emitters/loudspeakers and microphones/sensors providing a variety of different masking functions according to example embodiments. Referring to FIG. 1C, the general areas 130-160 may be focused areas where the various occupants tend to congregate and talk, such as areas divided by walls, areas with seating and/or media equipment, etc. In one example, the four locations, for example, may be similar in size and dimensions and may have varying numbers of occupants which are located in any one area at any one time. The amount of detected noise may vary from second to second, as detected by the sensors 116. The baseline sample period (e.g., 5, 10, 15 seconds) is used to detect noise and provide masking feedback information depending on the type of noise in the immediate area being monitored and in the surrounding areas. The frequencies identified, the amplitude, the type of noise, etc., are all specific parameters which must be identified via a digital signal processing detection procedure.

Each of the emitters 114 may be assigned a particular masking sound having a frequency, frequencies and/or amplitudes to output at any one time depending on the information detected from the nearest sensor/microphone 116. Each emitter may have a unique frequency range and amplitude to accommodate the varying degrees of audio detected throughout each of the environments 130-160. The environments are not independent of one another since the noise can vary from one environment to another. Noise in one location can be detected by all the other environments and will be identified by a particular decibel level differently at each sensor 116. In the example of FIG. 1C, the first environment 130 may produce a noise, such as background music, and may be setup so all emitters 114 within area 130 are emitting music, such as in a lobby or rest area. The areas 140 and 1560 may be working areas, such as conference areas or cubicle areas with multiple occupants, those areas may be subjected to sound masking noise, such as an inaudible or unrecognizable sound at frequencies F2 and F3 in area 140, and F1 and F2 in area 160. The frequencies may vary because the sensors 116 in those areas may detect different sound, the sound detected in 140 may include higher frequencies, such as F3 and the sound in area 160 may be a lower frequency, such as F1, and both environments may detect a similar frequency F2. It is important to note that the frequencies F1, F2, F3 . . . Fn, may represent frequency ranges and may not be based on a single frequency. Also a sound detected in one area may have a same source but provide a different frequency due to the distance and objects between the sound generation and the sensors 116 at the various different areas.

The masking signals applied to environments 140 and 160 may include different frequency ranges and amplitudes depending on the magnitude of the noise detected. The amplitudes of the noise signals detected in each environment may be proportional to the amplitude of the noise masking signals injected into each environment via the emitters 114 located in each environment. Each emitter may emit a different set of frequencies and amplitudes than all other emitters in the entire group of environments. Also, the emitters in one particular area may be performing a same or similar function of injection while the other environments are performing unique noise injection for all respective emitters depending on the configuration. In environment 150, a paging operation may occur where an occupant may be in a private office working and the emitters of area 150 may page that occupant to come to the front desk. The sound detected by the sensors 114 in other environments 130, 140 and 160 may adjust their amplitude and frequency ranges during the page to reduce the impact of noise detected in those environments (130, 140 and 160).

The audio-controlled areas 130-160 may also be dynamically created or identified based on a number of individuals that are speaking, an amount of noise detected by the microphones 116 and a period of time for the analysis. In one example the time period may be every 60 seconds. During that period of time, audio may be collected by one or more of the microphones 116. Then, the collected audio may be processed by a processor as part of the controller to identify the noise levels identified by each of the microphones 116. The noise can then be masked by applying a respective signal to each emitter 114 in the areas associated with the respective collected noise. The signals may vary in amplitude, frequency, time duration, media type (masking noise vs. music vs. paging audio, vs. emergency tone/alarm, etc.). The dynamically created areas are identified in FIG. 1D.

Figure 1D:
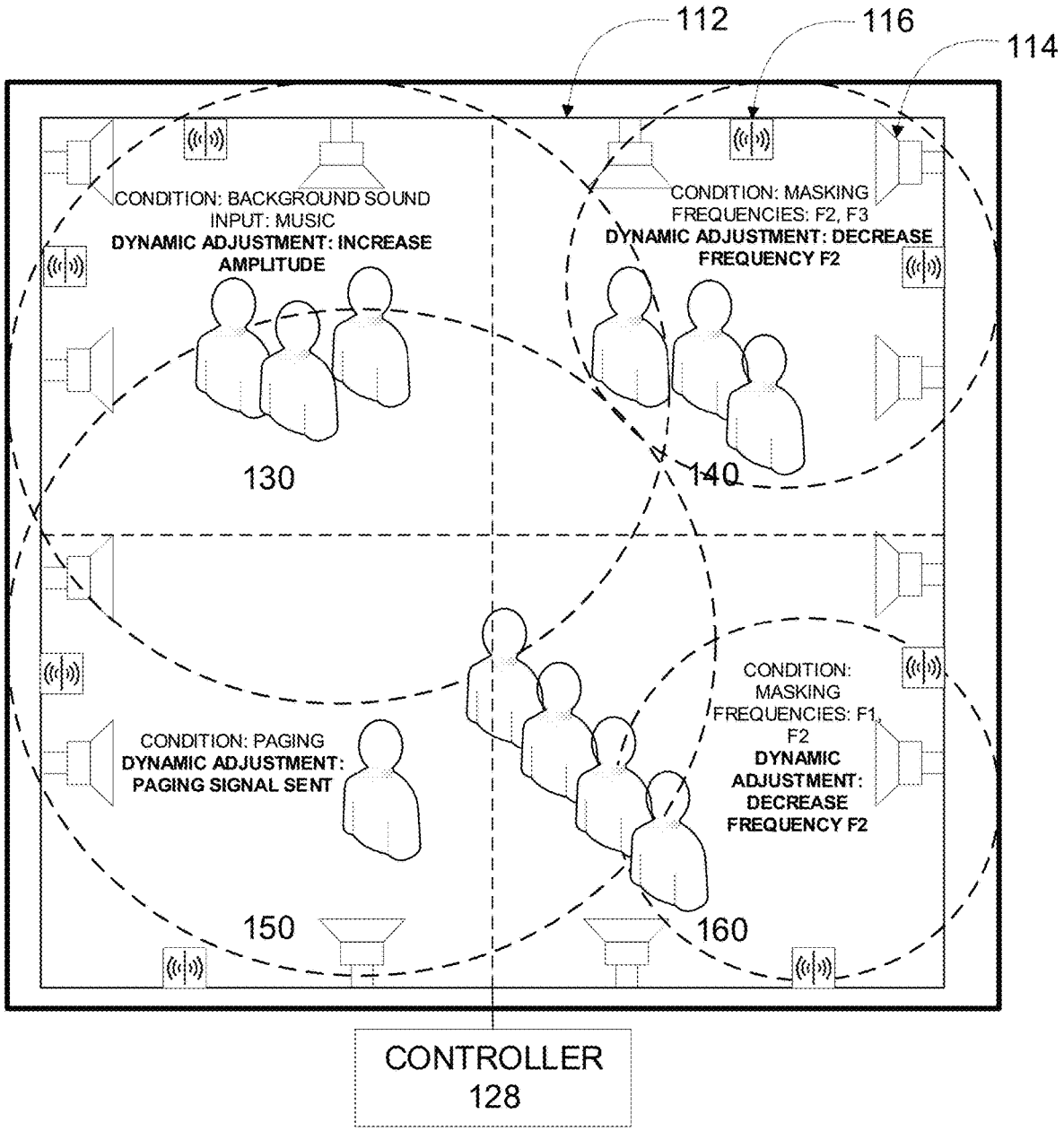
FIG. 1D illustrates another specific example of a controlled speaker environment with emitters/loudspeakers and microphones/sensors providing a variety of different masking functions according to example embodiments.

Referring to FIG. 1D, the noise signal generated by the paging signal in an example of outputting a paging call, may dynamically create a temporary environment 150 which is now larger, includes additional emitters, and may cause certain environments to increase in size (i.e., 130 and 150) or to decrease in size (i.e., 140 and 160) depending on the sound detected by the sensors 116 in those environments. The environments are dynamic and can be expanded or contracted to include fewer/more emitters, to include larger or smaller amplitudes of masking signals, etc., depending on the temporary actions performed. For example, paging in area 150 is a temporary action that lasts about 10 seconds, the area 150 may increase for that period of time to include 6 emitters as opposed to only 4 (default number of emitters per environment), while the others are shrunk to 2 or 3 emitters for that same period of time, and the amplitude of the masking in the smaller environments may increase during the same period of time and may decrease to a smaller amplitude once the time is expired.

The amplitude of noise detected in a particular area may cause the frequency to change and/or the amplitude of the output of the emitters 114 to rise based on the feedback processed by controller 128. The feedback may be a sensor identifying vibration, noise level, etc. The frequency selected and applied to the output of the emitters may cause the voices to be difficult to hear by other persons which are away from the source. For example, the persons in a particular area, such as 130 may all be talking out loud to one another and the others in the nearby areas 140, 150 and 160 may not be able to hear the voices from area 130 carrying over into their specific areas. The voices may sound distant like whispers so the distraction across the environment is kept to a minimum. The output of the emitters may be the same frequency and amplitude noise from all speakers/emitters 114. Alternatively, the amplitude and frequency may change so certain areas are outputting a smaller or larger output than others. The controller 128 may control the output levels and areas to perform different output signals based on the feedback received.

As illustrated in FIG. 1D, the dynamic modifications include a decrease in the output of the emitters in the 140 environment area. The output may include amplitude, frequency signal output, etc. In this case, the frequency range F2 is lessened by an amplitude value and/or an amount of emitters which are producing the F2 frequency range of masking signals. A similar approach is provided with area 160. The decision to perform the reduction in noise in those areas may be in part to the increasing areas of environments 130 and 150. In the previous example, the area 130 has undergone an increase in emitter output amplitude, such as background music and the area 150 has undergone an increase in the paging signal. The paging may begin, in one example, with a signal sent to a few emitters 114, then an additional number of emitters 114 may be added in a subsequent paging effort a short time thereafter. As the other areas sense the paging noise, the music may be increased in 130 and the masking at a particular frequency range F2 may be reduced to permit the paging to occur. Or, in areas where the paging is not intended to be received, the masking noise frequency range may be increased.

Sound masking signals (produced by the emitters/loudspeakers) are outputted throughout spaces where occupants are present that should not be distracted or where listeners are not intended to hear nearby conversations. Installing sound masking only near a particular talker (person talking) has no effect on interrupting their speech intelligibility to others. In enclosed spaces, sound masking is typically incorporated both inside and outside of the enclosed space to maintain speech privacy. In one example, sound masking signals placed outside of the enclosed space will prohibit in-room conversations from being overheard by building occupants passing near the space. Placing sound masking inside a room promotes speech privacy by "protecting" conversations taking place in the adjoining spaces, such as a private office, with fewer and smaller spaces.

For a sound masking deployment to be successful, little to no variation in the sound masking signal should be detected throughout a given space. Uniform distribution of sound masking is critical to occupant comfort, acceptance, as well as speech privacy performance. The distribution of sound masking is predicated on consistent and adequate emitter/loudspeaker placement throughout a space with coverage over the entire physical space, or 'wall-to-wall' coverage. 'Gaps' in sound masking coverage will be noticeable and distracting to a building occupant.

Additionally, proper sound-level adjustment will dictate project success in terms of occupant acceptance and comfort levels. It is critical that sound masking be installed when a space is unoccupied and calibrated to the proper sound levels prior to permitting occupants access to a space, and this applies to both new and existing facilities. Improper adjustment and installation during occupation will be distracting to occupants and greatly hinder acceptance by those occupants.

One example embodiment may include 'soft start' capabilities, which are calendar-based time periods where levels may be attenuated at first occupancy and increased gradually over time to the final sound masking level. The 'soft start' feature slowly acclimates occupants to sound masking and is used in spaces which are occupied with no sound masking installed. This process may include gradual sound masking start-up features which introduce the sound masking more and more over time. The amplitude and frequency ranges used may be provided in varying degrees over various time intervals. Direct field sound masking uses sound masking emitters/loudspeakers in the "direct field" (downward facing directed at listeners) permitting the sound masking signal to be delivered unimpeded by building architecture/finishes. The system platform utilizes predetermined/optimized sound masking spectrums (F1, F2, F3 . . . FN) based on which type of direct field sound masking emitter is connected to the control processor of the controller.

Indirect sound masking (directed upward away from listeners) commonly places loudspeakers above ceiling finishes using the structural deck to disperse sound evenly. This indirect approach is commonly referred to as "in-plenum," and requires that sound masking signal adjustment (equalization) be made within the application software by a qualified technician to compensate for the loss of signal through the ceiling materials. Control processors according to example embodiments provide both direct and indirect loudspeaker/emitter deployments. Models may be used in conjunction with one another to create a complete sound masking system to meet the needs of the architectural conditions in a facility. The number of loudspeaker/emitters required and their respective spacing is based on a variety of architectural conditions, such as mounting heights, a type of emitter providing the masking, air plenum depth, etc. Depending on the type of space and its intended use, target sound masking levels may vary from area to area throughout a facility. Multiple controller outputs as well as multiple controllers may serve 'virtual' zones of sound masking, which simplifies controls and adjustments. Outputs may be adjusted independently to compensate for emitter/loudspeaker mounting heights and architectural conditions present.

The areas for sound masking may be identified as virtual zones, since no permanent structures are necessary to provide sound masking. The configurations may serve specific architectural spaces and include background music and/or paging signals when used with supported emitter/loudspeakers by using external audio sources. Typical sound level targets may create effective/comfortable sound masking for common office environments, one example may include 44 dBA SPL (sound pressure level) to 48 dBA SPL as an estimated range of sound. Corridors may include 42 dBA SPL to 45 dBA SPL. Private offices may include 38 dBA SPL to 43 dBA SPL. 'A-weighted' sound masking levels in dB SPL are measured 4 ft (1.2 m) above finished floor using a calibrated sound pressure level meter, and a class 1 SPL meter/microphone is recommended.

In cases where sound masking levels exceed the above recommendations, occupant acceptance will diminish greatly and may lead to complaints, especially in extremely quiet environments. This may result in dissatisfaction with the sound masked environment and a request by staff to lower sound masking levels. This would ultimately reduce the effectiveness of the system. For this reason, each zone of the sound masking system should be calibrated and adjusted precisely upon installation using calibrated measurement equipment by the qualified installer.

Once sound masking levels are optimized for a space, the levels should be maintained indefinitely. Even slight changes in level may be noticed by building occupants when they occur. Sound masking may be adjusted in small increments over a longer period of time at specific times of day using scheduling functionality. Reducing sound masking levels at night (under conditions of little to no building occupancy) may be beneficial for security staff to detect intrusion.

Example embodiments provide daily scheduling functionality, which permits attenuation of the sound masking levels at specific hours of the day to meet reduced masking level needs. This scheduling functionality includes a "ramp duration time," which gradually adjusts levels during the scheduled timeframe. A gradual change in sound masking level reduces the potential that building occupants will notice and become distracted by changes. For example, a 15-minute ramp duration <1 dB attenuation, a 30 minute ramp duration with 1 dB to 1.5 dB attenuation, a 60 minute ramp duration with 2 dB to 2.5 dB attenuation, a 90 minute ramp duration with 3 dB to 4 dB attenuation, and a 120 minute ramp duration >4 dB attenuation.

The application software interface permits sound masking system designers to create and customize layouts that define how sound masking controllers, emitters, speakers and supported audio devices integrate within a floor plan and building infrastructure. The application software permits importing floor plan representations in numerous supported formats that integrate into the software interface, and creating a convenient representation of the physical space in which the sound masking system is installed. Sound masking zones (See FIG. 1A) are created based on the design requirements. Audio, including sound masking, paging background music and emergency audio (such as fire alarms) may also propagate to certain zones and are set according to priority via logic.

Figure 2:
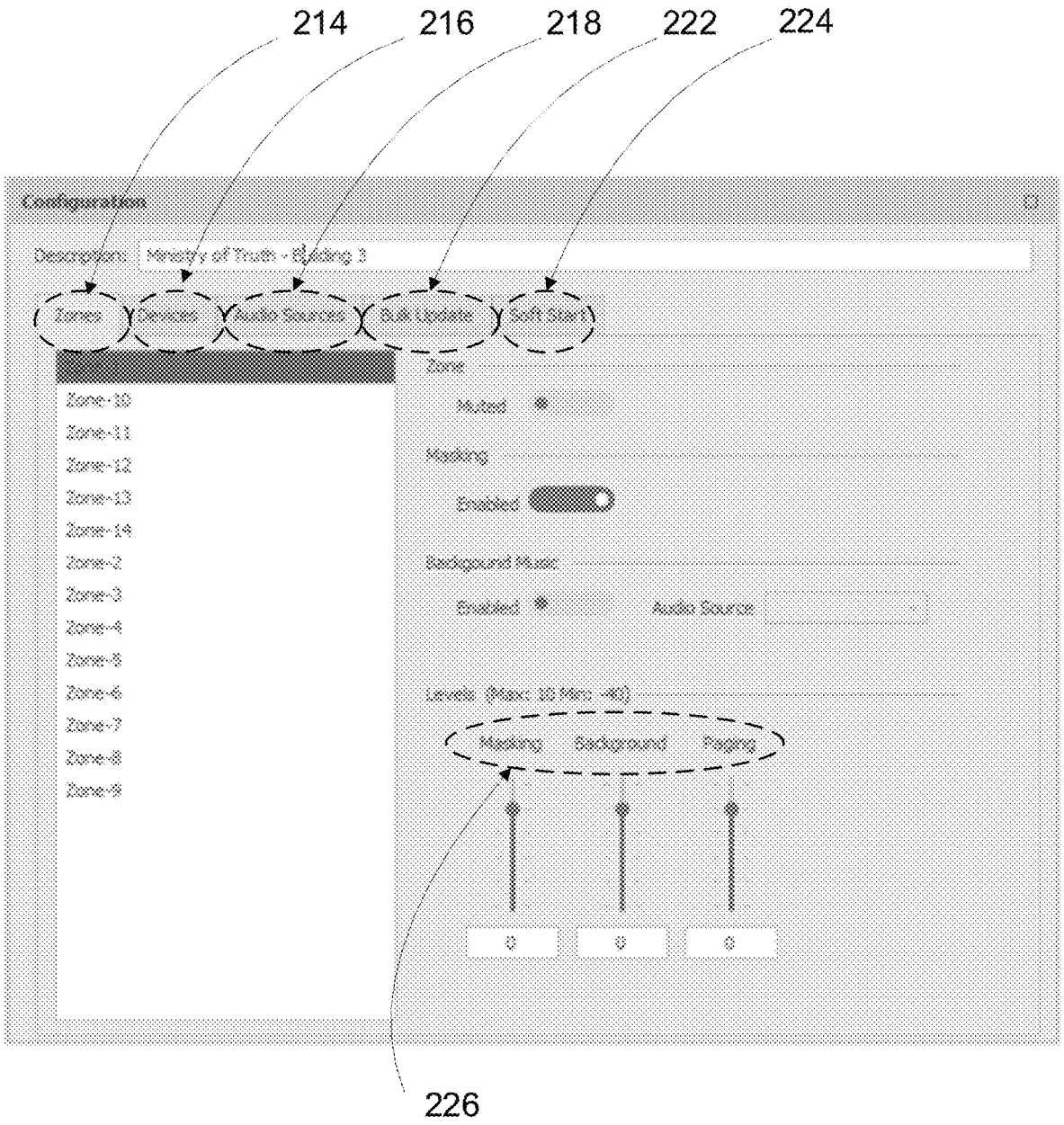
FIG. 2 illustrates a specific example of a user interface for enabling sound masking according to example embodiments.

FIG. 2 illustrates a specific example of a user interface for enabling sound masking according to example embodiments. Referring to FIG. 2, the user interface provides various options for selecting zones 214, devices to include in those zones 216, audio sources to provide 218, updated processes 222 and whether to offer a soft start 224 to provide the users with an aesthetic ramping up process during the initial onset of the masking noise. The masking may also be controlled with background noise and/or paging 226. Certain main menu options include opening, saving, and creating new files as well as adding/inserting devices, emitters and new floor plans. Tool bar buttons may be added or removed and further customized. Users may choose to import an image that represents the actual space in which the sound masking system is being installed, but that is not required. Floor plan images may be imported as a .pdf or numerous raster formats (.bmp, .jpeg, .png, etc.). Multiple floors may be added to the floor plan screen and toggled by clicking the desired tab at the top of the screen.

The sound masking channels and particular runs/zones in a sound masking system may include each signal cable including four 'non-time correlated' (different) noise sources per output zone. Since each run in a zone has a different sequence of noise sources that are placed directly adjacent to each other, comb filtering (acoustic interference) is not an issue. Consider four channels to be labelled A, B, C & D. The four sound masking channels are unique to each zone meaning that channel 'A' on zone 1 is independent of channel 'A' on zone 2, and so on, and can use completely different noise sources without concern for interference. However, these channels are not unique between the two cable run outputs on the controller device. Therefore, channel 'A' on zone 1 run 1 is the same audio source as channel 'A' on zone 1 run 2.

When determining a wiring pathway, it is important to ensure two emitters with the same channel and zone designation are not adjacent. Both non-active emitters and active emitters automatically sequence through the four audio channels as they are connected, therefore alleviating the manual task of assigning a unique channel to each emitter. The non-time correlated channels only pertain to sound masking sources (e.g., not audio, paging or music). When connected in daisy-chain, each channel automatically sequences to the next channel on the output jack of each emitter. One example emitter device channel begins the sequence as follows: zone 1–run 1=channels A,B,C,D,A,B,C,D,A,B etc.; zone 1–run 2=channels C,D,A,B,C,D,A,B,C,D etc.; zone 2–run 1=channels A,B,C,D,A,B,C,D,A,B etc.; zone 2–run 2=channels C,D,A,B,C,D,A,B,C,D etc.;

zone 3–run 1=channels A,B,C,D,A,B,C,D,A,B etc.; zone 3–run 2=channels C,D,A,B,C,D,A,B,C,D etc. The two-channel offset between run 1 and run 2 allows two rows of emitters to begin near the emitter device and adjacent to one another, which minimizes cabling distances to the controller in many cases.

The input jack and output jacks must be connected correctly in order to maintain the channel sequence and should not swap the in/out jacks when installing emitters. Two separate outputs are provided on the power injector for active emitters. In order to facilitate the ability to start cable runs in adjacent rows of emitters, another channel offset is provided. Output 1 of the injector uses the same channel sequence as the cable run from the emitter device, where output 2 offsets those same channels by a sequence of 2 channels as follows: zone 1–run 1–output 1=channels A,B,C,D,A,B,C,D etc.; zone 1–run 1–output 2=channels C,D,A,B,C,D,A,B etc.; zone 1–run 2–output 1=channels C,D,A,B,C,D,A,B etc.; zone 1–run 2–output 2=channels A,B,C,D,A,B,C,D etc.

Figure 3:
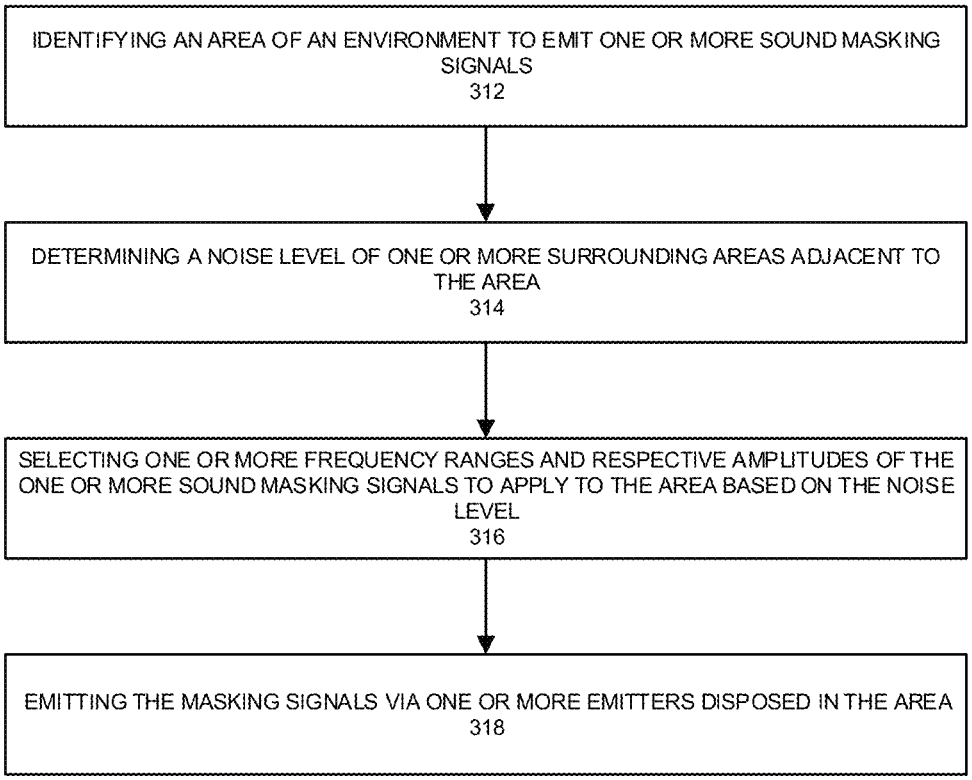
FIG. 3 illustrates a flow diagram of an example process for providing a sound masking function according to example embodiments.

FIG. 3 illustrates a flow diagram of an example process for providing a sound masking function according to example embodiments. Referring to FIG. 3, the process includes identifying an area of an environment to emit one or more sound masking signals 312, determining a noise level of one or more surrounding areas adjacent to the area 314, selecting one or more frequency ranges and respective amplitudes of the one or more sound masking signals to apply to the area based on the noise level 316 and emitting the masking signals via one or more emitters disposed in the area 318.

The area of the environment may include two or more emitters among a plurality of emitters disposed throughout the environment. The process may also include detecting a paging audio signal or a music audio signal present in the one or more surrounding areas, and selecting the one or more frequency ranges and the respective amplitudes based on the detected paging audio signal or the music audio signal. The emitting the masking signals via one or more emitters disposed in the area includes emitting one or more of a first frequency range and a first amplitude for a period of time and emitting one or more of a second frequency range and a second amplitude for a second period of time at the expiration of the first period of time. The process may include receiving a noise level feedback signal via one or more sensors disposed in the area, and selecting the one or more frequency ranges and respective amplitudes of the one or more sound masking signals to apply to the area based on the received noise level feedback signal. The process may also include applying a first masking frequency range to the area during a paging operation being conducted in one or more of the other areas, and applying a second masking frequency ranged after the paging operation is completed. The process may also include detecting a new noise level via one or more sensors while the masking operation is applied to the area, and emitting the masking signals to additional emitters in the one or more surrounding areas of the adjacent areas in addition to the emitters currently applying the masking signal.

The operations of a method or algorithm described in connection with the embodiments disclosed herein may be embodied directly in hardware, in a computer program executed by a processor, or in a combination of the two. A computer program may be embodied on a computer readable medium, such as a storage medium. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

Figure 4:
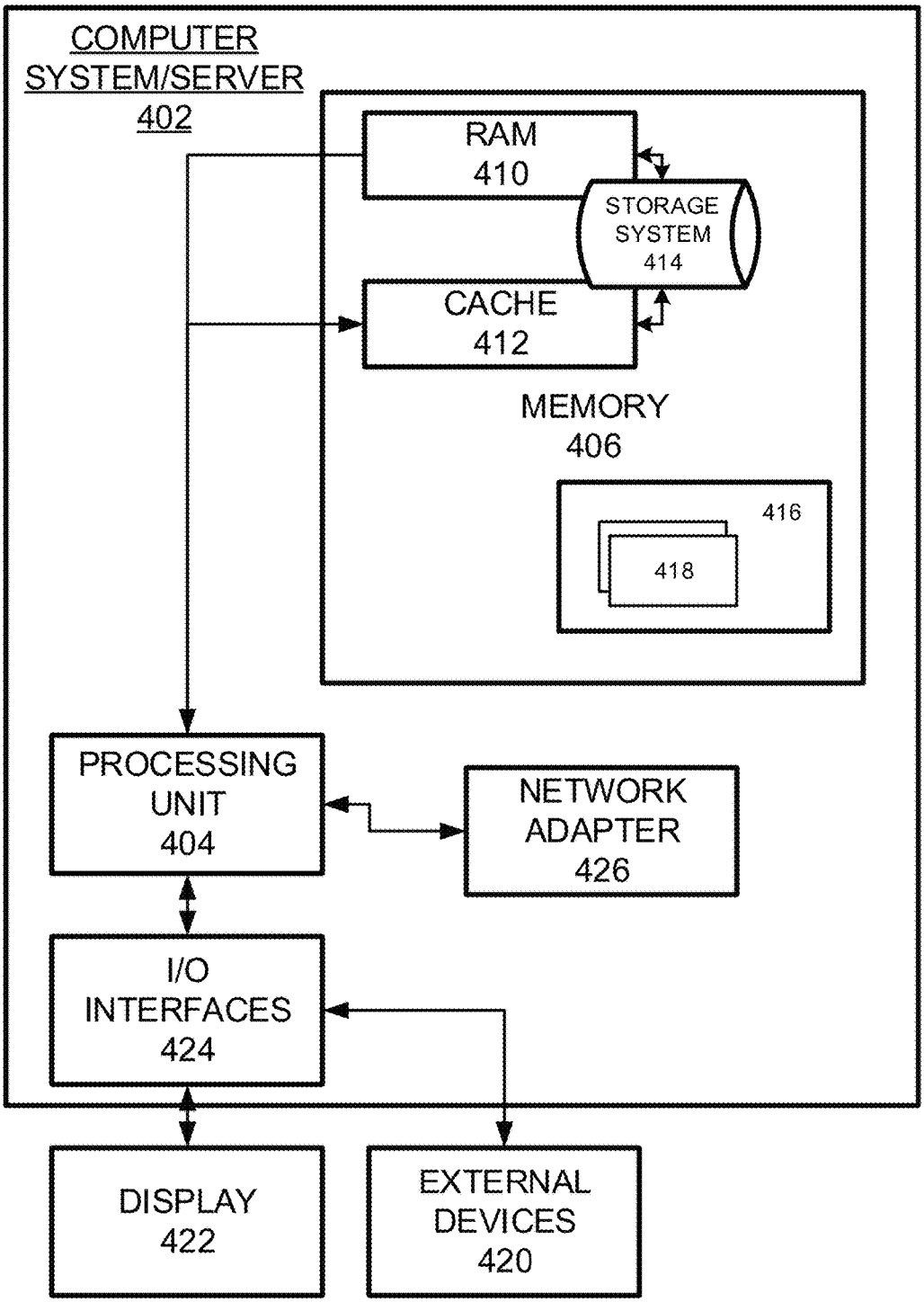
FIG. 4 illustrates an example system configuration configured to provide one or more functions according to example embodiments.

FIG. 4 is not intended to suggest any limitation as to the scope of use or functionality of embodiments of the application described herein. Regardless, the computing node 400 is capable of being implemented and/or performing any of the functionality set forth hereinabove.

In computing node 400 there is a computer system/server 402, which is operational with numerous other general purpose or special purpose computing system environments or configurations. Examples of well-known computing systems, environments, and/or configurations that may be suitable for use with computer system/server 402 include, but are not limited to, personal computer systems, server computer systems, thin clients, rich clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 402 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 402 may be practiced in distributed cloud computing environments where tasks are performed by remote processing devices that are linked through a communications network. In a distributed cloud computing environment, program modules may be located in both local and remote computer system storage media including memory storage devices.

As displayed in FIG. 4, computer system/server 402 in cloud computing node 400 is displayed in the form of a general-purpose computing device. The components of computer system/server 402 may include, but are not limited to, one or more processors or processing units 404, a system memory 406, and a bus that couples various system components including system memory 406 to processor 404.

The bus represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 402 typically includes a variety of computer system readable media. Such media may be any available media that is accessible by computer system/server 402, and it includes both volatile and non-volatile media, removable and non-removable media. System memory 406, in one embodiment, implements the flow diagrams of the other figures. The system memory 406 can include computer system readable media in the form of volatile memory, such as random-access memory (RAM) 410 and/or cache memory 412. Computer system/server 402 may further include other removable/non-removable, volatile/non-volatile computer system storage media. By way of example only, storage system 414 can be provided for reading from and writing to a non-removable, non-volatile magnetic media (not displayed and typically called a "hard drive"). Although not displayed, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus by one or more data media interfaces. As will be further depicted and described below, memory 406 may include at least one program product having a set (e.g., at least one) of program modules that are configured to carry out the functions of various embodiments of the application.

Program/utility 416, having a set (at least one) of program modules 418, may be stored in memory 406 by way of example, and not limitation, as well as an operating system, one or more application programs, other program modules, and program data. Each of the operating system, one or more application programs, other program modules, and program data or some combination thereof, may include an implementation of a networking environment. Program modules 418 generally carry out the functions and/or methodologies of various embodiments of the application as described herein.

As will be appreciated by one skilled in the art, aspects of the present application may be embodied as a system, method, or computer program product. Accordingly, aspects of the present application may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present application may take the form of a computer program product embodied in one or more computer readable medium(s) having computer readable program code embodied thereon.

Computer system/server 402 may also communicate with one or more external devices 420 such as a keyboard, a pointing device, a display 422, etc.; one or more devices that enable a user to interact with computer system/server 402; and/or any devices (e.g., network card, modem, etc.) that enable computer system/server 402 to communicate with one or more other computing devices. Such communication can occur via I/O interfaces 424. Still yet, computer system/server 402 can communicate with one or more networks such as a local area network (LAN), a general wide area network (WAN), and/or a public network (e.g., the Internet) via network adapter 426. As depicted, network adapter 426 communicates with the other components of computer system/server 402 via a bus. It should be understood that although not displayed, other hardware and/or software components could be used in conjunction with computer system/server 402. Examples include, but are not limited to: microcode, device drivers, redundant processing units, external disk drive arrays, RAID systems, tape drives, and data archival storage systems, etc.

One skilled in the art will appreciate that a "system" could be embodied as a personal computer, a server, a console, a personal digital assistant (PDA), a cell phone, a tablet computing device, a smartphone or any other suitable computing device, or combination of devices. Presenting the above-described functions as being performed by a "system" is not intended to limit the scope of the present application in any way but is intended to provide one example of many embodiments. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large-scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules and may be embodied in any suitable form and organized within any suitable type of data structure. The operational data may be collected as a single data set or may be distributed over different locations including over different storage devices, and may exist, at least partially, merely as electronic signals on a system or network.

It will be readily understood that the components of the application, as generally described and illustrated in the figures herein, may be arranged and designed in a wide variety of different configurations. Thus, the detailed description of the embodiments is not intended to limit the scope of the application as claimed but is merely representative of selected embodiments of the application.

One having ordinary skill in the art will readily understand that the above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent.

While preferred embodiments of the present application have been described, it is to be understood that the embodiments described are illustrative only and the scope of the application is to be defined solely by the appended claims when considered with a full range of equivalents and modifications (e.g., protocols, hardware devices, software platforms etc.) thereto.

What is claimed is:

1. A method, comprising:

identifying an area of an environment to emit one or more sound masking signals;

receiving one or more noise level feedback signals via one or more sensors disposed in the area;

determining one or more noise levels of one or more surrounding areas adjacent to the area based on the one or more noise level feedback signals;

selecting one or more frequency ranges and respective amplitudes of the one or more sound masking signals to apply to the area based on the one or more noise levels; and emitting the masking signals via one or more emitters disposed in the area, wherein a first masking signal comprises a first frequency range and first amplitude being emitted via a first emitter and a second masking signal comprises a second frequency range and second amplitude being emitted via a second emitter closer to a portion of the area where a noise level is different from a portion of the area closer to the first emitter.

2. The method of claim 1, wherein the area of the environment comprises two or more emitters among a plurality of emitters disposed throughout the environment.

3. The method of claim 1, comprising detecting a paging audio signal or a music audio signal present in the one or more surrounding areas; and selecting the one or more frequency ranges and the respective amplitudes based on a detected paging audio signal or music audio signal.

4. The method of claim 1, wherein the emitting the masking signals via one or more emitters disposed in the area comprises emitting one or more of a first frequency range and a first amplitude for a period of time and emitting one or more of a second frequency range and a second amplitude for a second period of time at the expiration of the first period of time.

5. The method of claim 1, comprising applying a first masking frequency range to the area during a paging operation being conducted in one or more of the other areas; and applying a second masking frequency ranged after the paging operation is completed.

6. The method of claim 1, comprising detecting a new noise level via one or more sensors while the masking operation is applied to the area; and emitting the masking signals to additional emitters in the one or more surrounding areas of the adjacent areas.

7. A system, comprising:

a plurality of emitters disposed throughout an environment; and a controller in communication with the plurality of emitters via a communication medium, and wherein the controller is configured to identify an area of the environment to emit one or more sound masking signals;

receive one or more noise level feedback signals via one or more sensors disposed in the area;

determine one or more noise levels of one or more surrounding areas adjacent to the area based on the one or more noise level feedback signals;

select one or more frequency ranges and respective amplitudes of the one or more sound masking signals to apply to the area based on the one or more noise levels; and emit the masking signals via one or more emitters disposed in the area, wherein a first masking signal comprises a first frequency range and first amplitude being emitted via a first emitter and a second masking signal comprises a second frequency range and second amplitude being emitted via a second emitter closer to a portion of the area where a noise level is different from a portion of the area closer to the first emitter.

8. The system of claim 7, wherein the area of the environment includes two or more emitters among a plurality of emitters disposed throughout the environment.

9. The system of claim 7, wherein the controller is further configured to detect a paging audio signal or a music audio signal present in the one or more surrounding areas; and select the one or more frequency ranges and the respective amplitudes based on a detected paging audio signal or music audio signal.

10. The system of claim 7, wherein the masking signals are emitted via one or more emitters disposed in the area by the controller being configured to emit one or more of a first frequency range and a first amplitude for a period of time and emit one or more of a second frequency range and a second amplitude for a second period of time at the expiration of the first period of time.

11. The system of claim 7, wherein the controller is further configured to receive a noise level feedback signal via one or more sensors disposed in the area; and select the one or more frequency ranges and respective amplitudes of the one or more sound masking signals to apply to the area based on the received noise level feedback signal.

12. The system of claim 7, comprising detecting a new noise level via one or more sensors while the masking operation is applied to the area; and emitting the masking signals to additional emitters in the one or more surrounding areas of the adjacent areas.

13. A non-transitory computer readable storage medium configured to store instructions that when executed cause a processor to perform:

identifying an area of an environment to emit one or more sound masking signals;

receiving one or more noise level feedback signals via one or more sensors disposed in the area;

determining one or more noise levels of one or more surrounding areas adjacent to the area based on the one or more noise level feedback signals;

selecting one or more frequency ranges and respective amplitudes of the one or more sound masking signals to apply to the area based on the one or more noise levels; and emitting the masking signals via one or more emitters disposed in the area, wherein a first masking signal comprises a first frequency range and first amplitude being emitted via a first emitter and a second masking signal comprises a second frequency range and second amplitude being emitted via a second emitter closer to a portion of the area where a noise level is different from a portion of the area closer to the first emitter.

14. The non-transitory computer readable storage medium of claim 13, wherein the area of the environment comprises two or more emitters among a plurality of emitters disposed throughout the environment.

15. The non-transitory computer readable storage medium of claim 13, wherein the processor is further configured to perform:

detecting a paging audio signal or a music audio signal present in the one or more surrounding areas; and selecting the one or more frequency ranges and the respective amplitudes based on a detected paging audio signal or music audio signal.

16. The non-transitory computer readable storage medium of claim 13, wherein the emitting the masking signals via one or more emitters disposed in the area comprises emitting one or more of a first frequency range and a first amplitude for a period of time and emitting one or more of a second frequency range and a second amplitude for a second period of time at the expiration of the first period of time.

17. The non-transitory computer readable storage medium of claim 13, wherein the processor is further configured to perform:

applying a first masking frequency range to the area during a paging operation being conducted in one or more of the other areas; and applying a second masking frequency ranged after the paging operation is completed.

* * * * *